US006701877B1

(12) United States Patent
Ottersbach et al.

(10) Patent No.: US 6,701,877 B1
(45) Date of Patent: Mar. 9, 2004

(54) CAMSHAFT CONTROL DEVICE AND CONTROL VALVE WITH LEAKAGE COMPENSATION

(75) Inventors: Rainer Ottersbach, Bonn (DE); Andreas Strauss, Forchheim (DE); Mike Kohrs, Wilthen (DE); Jochen Auchter, Aurachtal (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/913,450

(22) PCT Filed: Jan. 20, 2000

(86) PCT No.: PCT/EP00/00413

§ 371 (c)(1),
(2), (4) Date: Sep. 17, 2001

(87) PCT Pub. No.: WO00/47875

PCT Pub. Date: Aug. 17, 2000

(30) Foreign Application Priority Data

Feb. 11, 1999 (DE) ..... 199 05 646

(51) Int. Cl.[7] ..... F01L 1/34; F01L 1/04

(52) U.S. Cl. ..... 123/90.17; 91/31; 123/90.31; 137/625.69; 464/2

(58) Field of Search ..... 91/31; 123/90.17, 123/90.31; 464/2; 137/625.69

(56) References Cited

U.S. PATENT DOCUMENTS

| | | | | |
|---|---|---|---|---|
| 5,107,804 A | * | 4/1992 | Becker et al. | 123/90.17 |
| 5,483,930 A | | 1/1996 | Moriya et al. | 123/90.17 |
| 5,657,725 A | | 8/1997 | Butterfield et al. | 123/90.17 |
| 5,669,343 A | | 9/1997 | Adachi | 123/90.17 |

FOREIGN PATENT DOCUMENTS

| | | |
|---|---|---|
| DE | 2359022 | 6/1974 |
| DE | 3226696 | 2/1983 |
| DE | 4216791 | 11/1993 |
| DE | 4235929 | 4/1994 |
| DE | 19637174 | 3/1997 |
| DE | 19753915 | 6/1998 |
| DE | 19812183 | 10/1998 |
| EP | 0518528 | 12/1992 |

* cited by examiner

*Primary Examiner*—F. Daniel Lopez
(74) *Attorney, Agent, or Firm*—Muserlian, Lucas and Mercanti

(57) ABSTRACT

The invention concerns a control device for adjusting the relative angular position of a driven shaft, particularly a camshaft of an internal combustion engine, said device comprising a drive pinion that is rotatably connected to the shaft, an adjusting element (1) for the angular adjustment of the drive pinion relative to the shaft, two chambers (2, 3) that are alternately supplied with hydraulic fluid and a control valve (6) for actuating the adjusting element (1), said control valve being connected to the chambers (2, 3) of the adjusting element (1) through pressure medium channels (4, 5). The control valve (6) comprises a valve body (7) that has two working connections A and B for the pressure medium channels (4, 5), a delivery connection P for the supply of hydraulic fluid and a discharge connection T for the discharge of hydraulic fluid, and the control valve (6) further comprises a sliding valve control piston (8) for setting different hydraulic resistances W between the individual connections. In an intermediate adjusted position of the valve control piston (8), for setting an intermediate phase angle, a lower hydraulic resistance W prevails between the delivery connection P and that one of the working connections A and B at which a design-related, higher fluid leakage V occurs.

2 Claims, 2 Drawing Sheets

CAMSHAFT CONTROL DEVICE AND CONTROL VALVE WITH LEAKAGE COMPENSATION

This application is a 371 of PCT/EP00/00413 filed Jan. 20, 2000.

FIELD OF THE INVENTION

The invention concerns a control device for adjusting a relative angular position of a driven shaft, particularly a camshaft of an internal combustion engine, with the following features

- the control device comprises a drive pinion that is rotatably connected to the shaft,
- the control device comprises an adjusting element (1) for the angular adjustment of the drive pinion relative to the shaft, and further comprises chambers (2,3) that are alternately supplied with hydraulic fluid,
- the control device further comprises a control valve (6) for actuating the adjusting element (1), said control valve being connected to the chambers (2,3) of the adjusting element (1) through pressure medium channels (4,5),
- the control valve (6) comprises a valve body (7) comprising working connections A and B for the pressure medium channels (4,5), a delivery connection P for the supply of hydraulic fluid and a discharge connection T for the discharge of hydraulic fluid,
- the control valve (6) further comprises a sliding valve control piston (8) for setting different hydraulic resistances W between the individual connections,
- in a first adjusted position of the valve control piston (8), the connections between the connections P and A and between the connections B and T have a low resistance W and the connections between the connections P and B and between the connections A and T have a high resistance W,
- in a second adjusted position of the valve control valve (8), the connections between the connections P and B and between the connections A and T have a low resistance W and the connections between the connections P and A and between the connections B and T have a high resistance W,
- in a third adjusted position of the valve control valve (8), the connections between the connections A and T and between the connections B and T and the connections between the connections P and A and between the connections P and B have a high resistance W. The invention further concerns a control valve for actuating the adjusting element of a control device for adjusting the relative angular position of a driven shaft.

BACKGROUND OF THE INVENTION

A control device of the pre-cited type is known from U.S. Pat. No. 5,483,930. Through an adequate positioning of the valve control piston of the control valve in a hold position by a control circuit it is assured that one of the chambers of the adjusting element of the control device is supplied with an additional quantity of hydraulic fluid for compensating fluid leakage and stabilizing the position of the adjusting piston of the adjusting element.

OBJECT OF THE INVENTION

The object of the invention is to provide a control device for adjusting a relative angular position of a driven shaft, particularly a camshaft of an internal combustion engine, which device enables a compensation of fluid leakage in a hold position of the valve control piston without a controlled positioning of the valve control piston.

SUMMARY OF THE INVENTION

This and other objects of the invention, which will also become obvious from the following description of the invention, are achieved by the fact that, in a third adjusted position (hold position) of the valve control piston of the control valve of the control device of the invention, to compensate for fluid leakage from the pressure medium channel of the connection A, the resistance in the connection between the connections P and A is lower than the resistance in the connection between the connections P and B, whereas to compensate for fluid leakage from the pressure medium channel of the connection B, the resistance in the connection between the connections P and B is lower than the resistance in the connection between the connections P and A.

With a control device of this type, the phase angle of the camshaft of an internal combustion engine can be set by an angular displacement between the camshaft and the belt- or chain-driven drive pinion not only for two end positions, namely, a first adjusted position with the phase angle "advance" and a second adjusted position with the phase angle "delay", but also for an intermediate, third adjusted position (hold position) in which the value of the phase angle lies between the two extremes.

When an intermediate phase angle corresponding to a third adjusted position of the valve control piston of the control valve of the control device is set, a medium drive torque of the internal combustion engine having a dynamic and a static component is applied to the camshaft and, thus, to the chambers of the adjusting element of the control device. The dynamic torque component is applied substantially uniformly to the two chambers thus assuring an alternating supply of hydraulic fluid thereto, while the static torque component loads only one of the two chambers and thus the pressure medium channel connected to this chamber and the associated working connection of the valve body of the control valve.

A force and torque analysis taking into consideration the structure of the control device and the internal combustion engine makes it possible to predict which of the chambers and, thus also, which of the pressure medium channels and working connections of the valve body will be loaded by the static component of the torque of the internal combustion engine. During operation of the control device, increased leakage of fluid is to be expected at the loaded pressure medium channel and the associated working connection.

By the inventive structural measures implemented in the control valve, it is achieved that, in an intermediate adjusted position (hold position), for stabilizing the valve control piston for setting an intermediate phase angle, the pressure medium channel and the associated working connection of the control valve which will predictably be loaded by the static torque component have a lower hydraulic resistance to the delivery connection P than the pressure medium channel and the associated working connection that are not loaded by the static torque component.

Due to the lower hydraulic resistance set at the loaded connection, a larger volume of hydraulic fluid is supplied to the loaded pressure medium channel for compensating leakage of hydraulic fluid. This, at the same time, also stabilizes the position of the piston of the adjusting element.

By the inventive structural measures implemented in the valve control piston and/or in the valve body of the control valve, it is achieved that a larger volume of hydraulic fluid is supplied to the pressure medium channel and the associated working connection of the control valve loaded by the static torque component for compensating for the fluid leakage that has occurred there. In contrast to the prior art, there is no need for an expensive and interference-prone positioning of the valve control piston by a control circuit. Rather, it is possible in the control device of the invention, to use a 4/3 proportional valve, known per se, with a structurally modified valve control piston and/or valve body and defined adjusted positions (first position "advance", second position "delay" and third position "hold"). Compared to the prior art, in the control device of the invention, the pressure rigidity of the control valve and the torque rigidity of the entire hydraulic system of the control device are improved.

In an advantageous embodiment of the invention, for compensating for fluid leakage, the delivery connection P is connected through a connecting duct to the loaded pressure medium channel of the respective working connection of the control valve, so that more hydraulic fluid is supplied to this pressure medium channel than to the other channel. Such a connecting duct having a by-pass function can also be added subsequently to the control valve without structural modifications to the valve control piston and/or the valve body. The arrangement of a throttle in the connecting duct assures that a larger amount of hydraulic fluid is supplied to the loaded pressure medium channel as a compensation for leakage, above all when there is a higher working pressure at the delivery connection, and a back flow of hydraulic fluid from the pressure medium channel toward the delivery connection is also substantially prevented.

According to a further advantageous proposition of the invention, the connecting duct further comprises a one-way valve to reliably prevent a back flow of hydraulic fluid from the loaded pressure medium channel to the delivery connection. By a series connection of a throttle and a one-way valve in the connecting duct, the advantageous features of these can be jointly utilized. Alternatively, it is also possible to use a one-way valve having an adjustable biasing force. As an alternative or as a supplement to an external connecting duct between the delivery connection and the loaded pressure medium channel, a compensation for fluid leakage at this channel can also be effected with the control device of the invention by implementing suitable structural measures in the valve body and/or the valve control piston of the control valve.

In a further advantageous embodiment of the invention, the grooves and control regions of the valve control piston that is configured as a sliding piston can be arranged so that, in a third adjusted position (hold position), for realizing an intermediate phase angle of the camshaft, a lower hydraulic resistance prevails between the delivery connection of the control valve and the working connection of the loaded pressure medium channel, and, due to the resulting larger flow volume of hydraulic fluid compared to the connection between the delivery connection and the working connection of the non-loaded pressure medium channel, a compensation for fluid leakage at the loaded pressure medium channel takes place. In a control valve having a delivery connection arranged centrally between the two working connections, the grooves of the valve control piston can be arranged asymmetrically relative to a central axis of the delivery connection, so that in the hold position of the valve control piston, due to this groove arrangement, a lower hydraulic resistance prevails between the delivery connection and the loaded working connection than between the delivery connection and the non-loaded working connection. A compensation for fluid leakage at the loaded pressure medium channel and the associated working connection can also be effected by configuring the control edges of the valve body and/or the control regions of the valve control piston with different geometric shapes (e.g. chamfers, notches, curvatures etc.). The control edges of the valve body and/or the control regions of the valve control piston, for example, can have different radii of curvature.

The control valve of the invention serves particularly for the actuation of the adjusting element of a control device for the relative angular adjustment of a driven shaft, particularly a camshaft of an internal combustion engine. To effect a compensation for fluid leakage occurring at the loaded pressure medium channel of a working connection, the control valve can have the features described in connection with the control device of the invention. Neither the control device of the invention nor the control valve of the invention is restricted in use to adjusting elements functioning according to a particular principle of operation. The described control device and control valve can be used in camshaft adjusters both of an axial and a radial piston type.

BRIEF DESCRIPTION OF THE DRAWINGS

The invention is described more closely below with reference to the following preferred embodiments of the invention illustrated in the appended drawings.

DETAILED DESCRIPTION OF THE DRAWINGS

Figure 1:
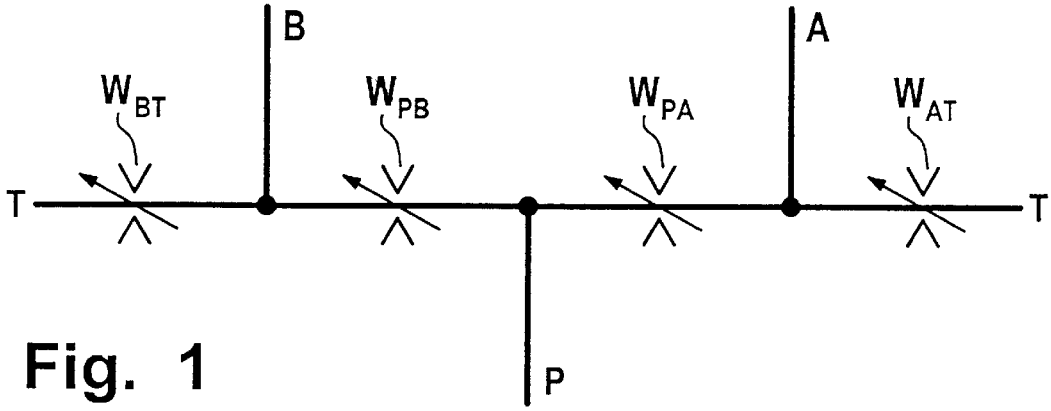
FIG. 1 is an operational diagram of a control valve having adjustable hydraulic resistances.

In the operational diagram of FIG. 1 of a control valve of a control device for the relative angular adjustment of a driven shaft, the control valve 6, not shown, possesses working connections A and B leading from the valve body 7 to pressure medium channels 4 and 5, not shown, and a delivery connection P for the supply of hydraulic fluid and two discharge connections T for the discharge of hydraulic fluid. Adjustable hydraulic resistances W achieved, for example, by an adjustment of the valve control piston 8, prevail between the individual connections.

In an adjusted position for setting an intermediate phase angle of a camshaft of an internal combustion engine, i.e. in a hold position, the valve piston of the adjusting element is stabilized by high resistances $W_{AT}$ and $W_B$. At the same time, high resistances $W_{PA}$ and $W_{PB}$ prevent a supply of hydraulic fluid from the delivery connection P.

The invention provides that, when a design-related leakage flow occurs at the working connection A and the associated pressure medium channel 4, the resistance $W_{PA}$ is lower than the resistance $W_{PB}$ As a result a larger volume of hydraulic fluid flows from P to A, so that the leakage at A is compensated for and the adjusting piston is stabilized.

Figure 2:
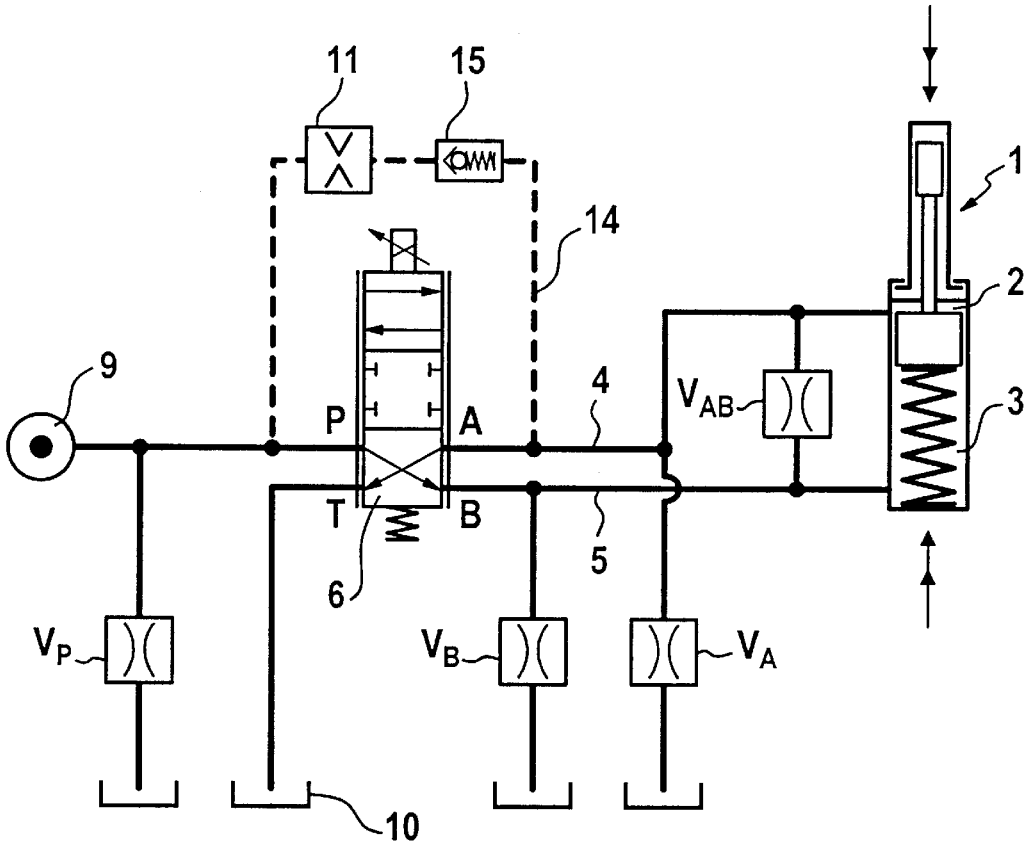
FIG. 2 is an elementary diagram of a control device having a connecting duct between a delivery connection P and the working connection A.

FIG. 2 is an elementary diagram of the entire control device having an adjusting element 1 with two chambers 2 and 3. Chamber 2 is connected through the pressure medium channel 4 to the working connection A and chamber 3 is connected through the pressure medium channel 5 to the working connection B. The control element 6 that is configured as a 4/3 proportional valve further comprises a delivery connection P to the pump 9 and a discharge connection T to the drain 10. Leakage flows $V_{AB}$ occur between the chambers 2 and 3 ("internal leakage) and leakage flows $V_A$, $V_B$ and $V_P$ occur at the connections A, B and P. Contingent upon the design, the leakage $V_A$ at the connection A and at the associated pressure medium channel 4 is much higher than at the other connections.

When, in an intermediate position, the adjusting element 1 sets an intermediate phase angle, i.e. the chambers 2 and 3 are approximately equal in size, and this intermediate phase angle has to be stabilized by adjustment of the intermediate position ("hold position) of the control valve 6, the higher leakage flow $V_A$ at the working connection A is compensated for by a supply of hydraulic fluid through the connecting duct 14. The control valve 6 is a common commercial 4/3 proportional valve with defined adjusting positions, and the advantageous effect of leakage compensation is achieved by way of the external connecting duct 14. To prevent and/or reduce a back flow from the working connection A to the delivery connection P, the connecting duct 14 comprises a throttle 11 and a one-way valve 15.

Figure 3:
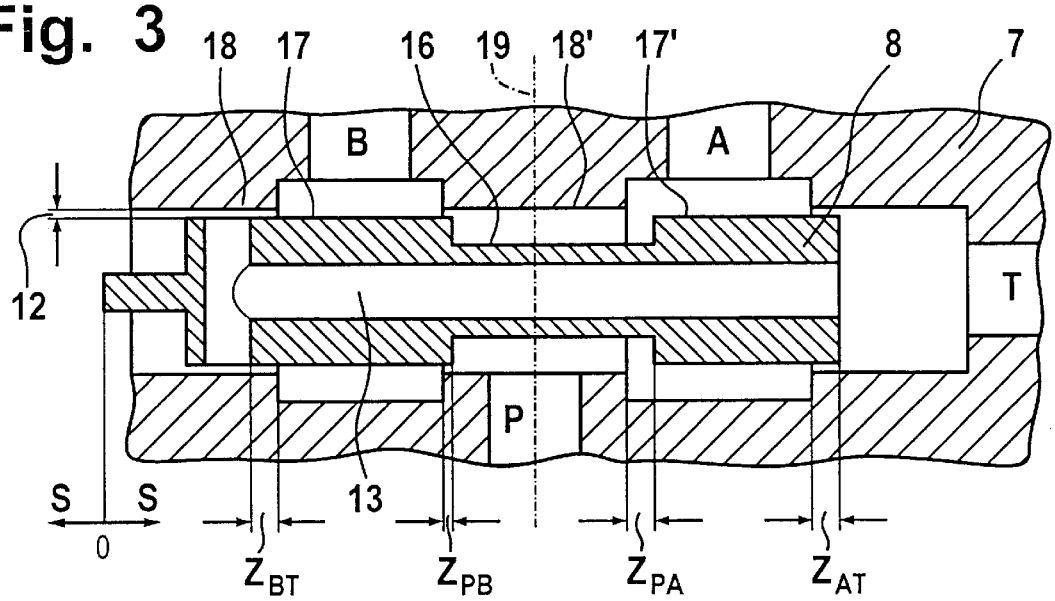
FIG. 3 is a sectional view of a control valve having an asymmetric valve control piston.
Figure 4:
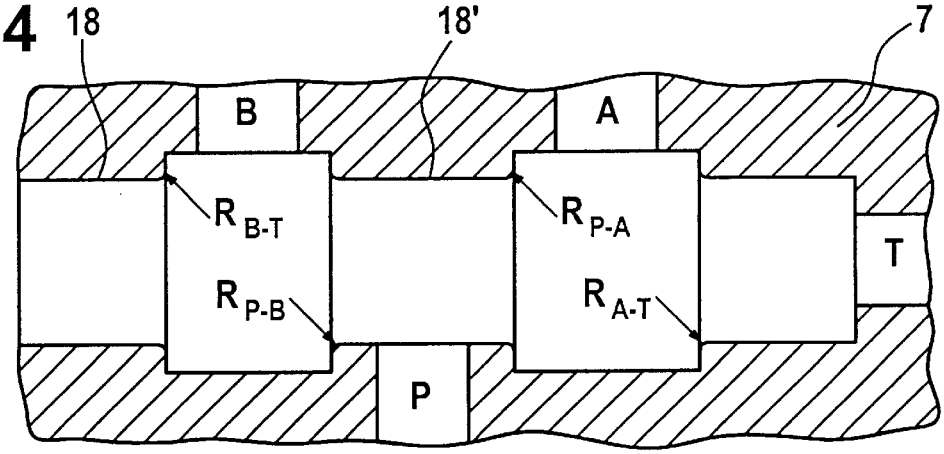
FIG. 4 is a sectional view of a valve body of a control valve having rounded control edges.
Figure 5:
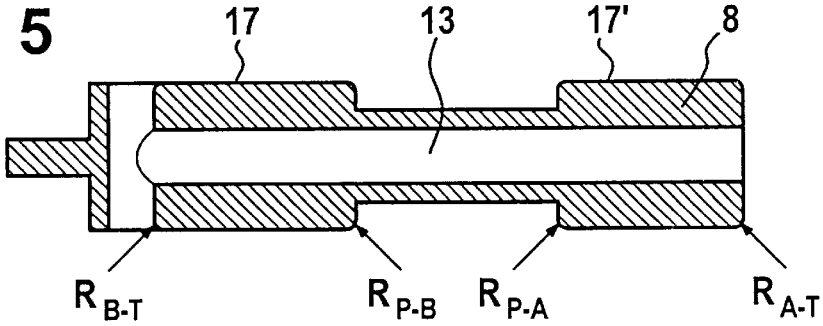
FIG. 5 is a view of a valve control piston of a control valve having rounded control edges.

In the sectional view of FIG. 3, the valve control piston 8 of the control valve 6 in the valve body 7 is in a hold position for stabilizing an intermediate adjusted phase angle of the camshaft. Apart from the radial clearance 12, a high resistance W prevails between the connections A and T as well as between the connections B and T so that the hydraulic fluid in the connections A and B and the associated pressure medium channels 4 and 5, and thus also in the chambers 2 and 3 of the adjusting element 1 (not shown) is prevented from flowing out with the result that the adjusting piston of the adjusting element 1 is retained in the intermediate adjusted position. To compensate for a design-related fluid leakage that occurs at the connection A and at the associated pressure medium channel 4, the hydraulic resistance W between the delivery connection P and the connection A is lower than the resistance between P and B. This is achieved by the fact that in the hold position, the control region 17' of the valve control piston 8, compared to the control region 17, is arranged asymmetrically (offset to the right) relative to the central axis 19 of the delivery connection P. This results in a negative supply overlap $Z_{PA}$ (actually, a lack of overlap) compared to the supply overlap $Z_{PB}$ Due to the negative overlap $Z_{PA}$, additional hydraulic fluid is supplied to the connection A to compensate for the leakage taking place there. By supply overlap Z is meant the geometric overlap, or lack of overlap, of the control edges 18 and 18' of the valve body 7 and the corresponding control regions 17 and 17' of the valve control piston 8. In the case of the valve control piston 8 of FIG. 3, the supply overlaps $Z_{AT}$ and $Z_B$ in the end regions are substantially identical. The valve control piston 8 is arranged in the valve body 7 for sliding axially through the adjusting distance S. In the right-hand end position, B communicates with T through the inner channel 13 of the valve control piston 8, and in the left-hand end position of the valve control piston 8, A communicates with T for the discharge of hydraulic fluid. As an alternative or as a supplement to the proposed arrangement of the groove 16 and the control regions 17, 17' of the valve control piston 8, the control edges 18 of the valve body 17 or the control regions 17 of the valve control piston 8 can also be geometrically modified (cf. FIGS. 4 and 5).

When a design-related higher fluid leakage takes place at the connection A, a lower hydraulic resistance W between the delivery connection P and the working connection A can be achieved, for example, by making the radius $R_{P\text{-}A}$ of the control edge 18' larger than the radii R of the other control edges of the valve body 7. The same effect can be achieved by making the radii R on the valve control piston 8 with different values and/or by giving the control edges 18 different configurations through additional geometric measures (e.g. flattening, notching etc.) so that the desired lower hydraulic resistance between the delivery connection P and the loaded working connection A is achieved to effect a compensation for the leakage loss in a hold position of the valve control piston 8.

LIST OF REFERENCE NUMERALS

1 Adjusting element
2 Chamber
3 Chamber
4 Pressure medium channel
5 Pressure medium channel
6 Control valve
7 Valve body
8 Valve control piston
9 Pump
10 Drain
11 Throttle
12 Radial clearance
13 Inner channel
14 Connecting duct
15 One-way valve
16 Groove
17 Control region
17' Control region
18 Control edge
18' Control edge
19 Central axis
A Working connection
B Working connection
P Delivery connection
R Radius
S Adjusting distance
T Discharge connection
V Fluid leakage
W Hydraulic resistance

What is claimed is:

1. A control device for adjusting a relative angular position of a driven shaft, particularly a camshaft of an internal combustion engine, with the following features:

the control device comprises a drive pinion that is rotatably connected to the shaft, the control device comprises an adjusting element (1) for the angular adjustment of the drive pinion relative to the shaf, and further comprises chambers (2, 3) that are alternately supplied with hydraulic fluid, the control device further comprises a control valve (6) for actuating the adjusting element (1), said control valve being connected to the chambers (2, 3) of the adjusting element (1) through pressure medium channels (4, 5), the control valve (6) comprises a valve body (7) comprising working connections A and B for the pressure medium channels (4, 5), a delivery connection P for the supply of hydraulic fluid and a discharge connection T for the discharge of hydraulic fluid, the control valve (6) further comprises a sliding valve control piston (8) for setting different hydraulic resistances W between the individual connections, in a first adjusted position of the valve control piston (8), the connections between the connections P and A and between the connections B and T have a low resistance W and the connection between the connections P and B and between the connections A and T have a high resistance W, in a second adjusted position of the valve control piston (B), the connections between the connections between P and b and between the connections A and T have a low resistance W and the connections between the connections P and A and between the connections B and T and a high resistance W, in the third adjusted position of the valve control valve (8), the connections between the connections A and T and between the connections B and T and the connections between the connections P and A and between the connections P and B have a high resistance W, wherein in the third position, either to compensate for fluid leakage V from the pressure medium channel (4) at the connection A, the delivery connection P is connected by a connecting duct (14) to the pressure medium channel (4) of the connection A, or to compensate for fluid leakage V from the pressure medium channel (5) at the connection B, the delivery connection P is connected by a connecting duct (14) to the pressure medium channel (5) of the connection b and wherein the connecting duct (14) comprises a throttle (11).

2. A control device according to claim 1, wherein to prevent a back flow to the delivery connection P, the connecting duct (14) comprises a one-way valve (15).

* * * * *